United States Patent [19]

Fujimoto et al.

[11] Patent Number: 4,753,431

[45] Date of Patent: Jun. 28, 1988

[54] NOTE STORING APPARATUS

[75] Inventors: Masahiro Fujimoto, Kusatsu; Masato Nishikawa, Kyoto; Atsushi Mizoguchi, Nagaokakyo, all of Japan

[73] Assignee: Omron Tateisi Electronics Co., Kyoto, Japan

[21] Appl. No.: 923,864

[22] Filed: Oct. 28, 1986

[30] Foreign Application Priority Data

Oct. 28, 1985 [JP] Japan ..... 60-242187

[51] Int. Cl.[4] ..... B65H 5/06

[52] U.S. Cl. ..... 271/301; 271/111; 271/117; 271/180; 271/219

[58] Field of Search ..... 271/3.1, 177, 180, 111, 271/219, 117

[56] References Cited

U.S. PATENT DOCUMENTS

| | | | |
|---|---|---|---|
| 3,220,724 | 11/1965 | Von Glahn | 271/177 X |
| 3,981,497 | 9/1976 | Feinstein | 271/117 X |
| 4,339,119 | 7/1982 | Sasaki | 271/180 |
| 4,616,817 | 10/1986 | Yamauchi | 271/3.1 X |
| 4,625,870 | 12/1986 | Nao | 271/3.1 X |

*Primary Examiner*—Richard A. Schacher

*Attorney, Agent, or Firm*—Stevens, Davis, Miller & Mosher

[57] ABSTRACT

An apparatus having a pushing tray in a note storage compartment. The pushing tray moves downwardly to provide enough space to store notes smoothly. During a delivery operation, a gate lever compresses the stored notes to a predetermined pressure against the pushing tray, allowing the stored notes, even crumpled, to be delivered smoothly one after another.

5 Claims, 5 Drawing Sheets

NOTE STORING APPARATUS

FIELD OF THE INVENTION

This invention relates to a note storing apparatus for storing notes in an automatic teller machine and, more particularly to an improved apparatus which may smoothly stack up notes therein.

A note storing apparatus which vertically stores deposited notes and delivers a predetermined number of the stored notes upon a withdrawal instruction is well known. The stored notes have to be pushed by a pushing plate toward the entrance and exit of a note storage compartment to prevent them from turning over since the note storage compartment of the conventional apparatus is designed to store notes vertically. The notes to be stored often jam because the pushing plate pushes the already stored notes toward the entrance and exit of the note storage compartment to provide almost no space for storing the note smoothly. Moreover, the storage space is too small to store many notes because the pushing plate pushes the stored note. Although there has been developed heretofore a note storing apparatus which stores notes horizontally, it cannot overcome the disadvantages of the above-described vertical storage apparatus.

SUMMARY OF THE INVENTION

It is, therefore, an object of this invention to provide a note storing apparatus which has enough space to store notes smoothly.

It is a further object of this invention to provide a note storing apparatus which smoothly delivers even crumpled notes one after another.

According to this invention, there is provided a note storing apparatus comprising note storage means for storing notes; pushing means disposed in the note storage means for receiving notes horizontally thereon, the pushing means being downwardly movable to produce a space to receive notes;

first feeding roller means for feeding notes into the space;

gate lever means for compressing notes against the pushing means when the pushing means is moved upwardly, the gate lever means being movable up and down; and delivery roller means for delivering notes from the space to the outside of the note storage means.

DESCRIPTION OF THE PREFERRED EMBODIMENTS

Figure 1:
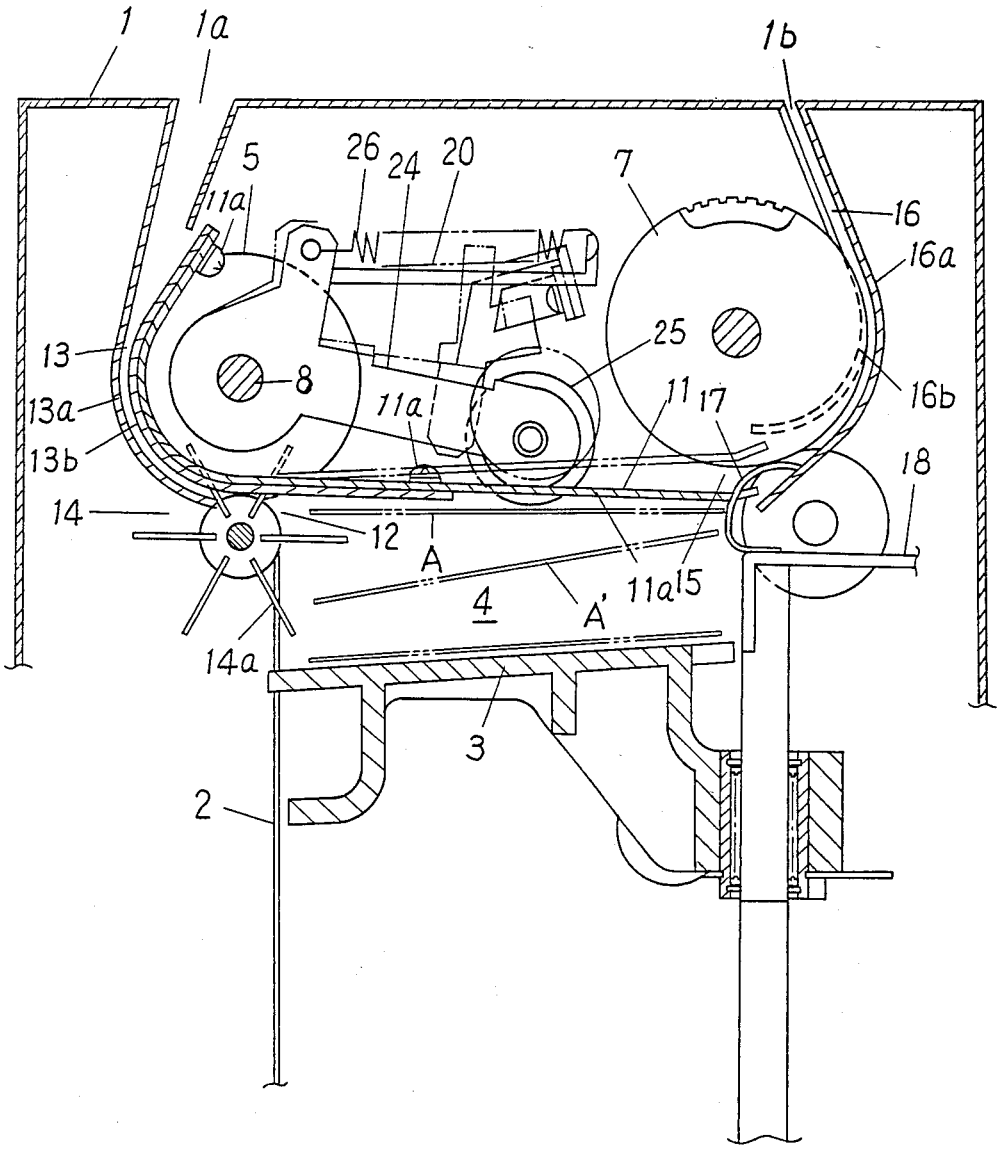
FIG. 1 is a cross-sectional view of a note storing apparatus as a preferred embodiment of this invention.

Referring now to FIG. 1, there is shown a note storing apparatus employed in an automatic teller machine as one preferred embodiment of this invention. The upper end opening 1*a* and 1*b* of a cartridge 1 is the entrance and delivery opening for a note, respectively. In a note storage compartment 2, a pushing tray 3 is disposed as a pushing means on which notes are received and horizontally stacked up. The pushing tray 3 moves downwardly, along a guide member 3*a*, in proportion to the total weight of the stored notes to produce a constant volume of space 4. Thus, the pushing tray 3 prevents a note A fed into the note storage compartment 2 from jamming and allows it to be stored smoothly. A driver, (not shown in the drawings) having a pulse motor and timing belts to impart rotation from the motor, is employed to move the pushing trays 3 up and down. If desired, another type of driver may be employed.

Figure 3:
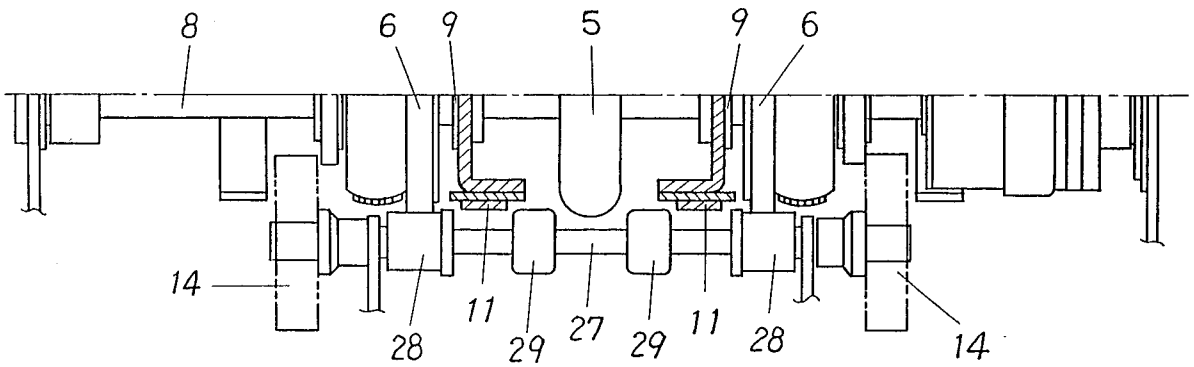
FIG. 3 is a partial side view showing a major portion of a roller section of the apparatus.

First feeding rollers 5 and 6 are fixed to a rotary shaft 8 near the entrance 1*a*, which are also shown in FIG. 3 in detail, and a pair of delivery rollers 7 are fixed to a rotary shaft 36. The first feeding rollers 5 and 6 are rotated in a predetermined direction during the operation of feeding the note A into the note storage compartment 2, and the delivery rollers 7 are rotated during a delivery operation.

Figure 2:
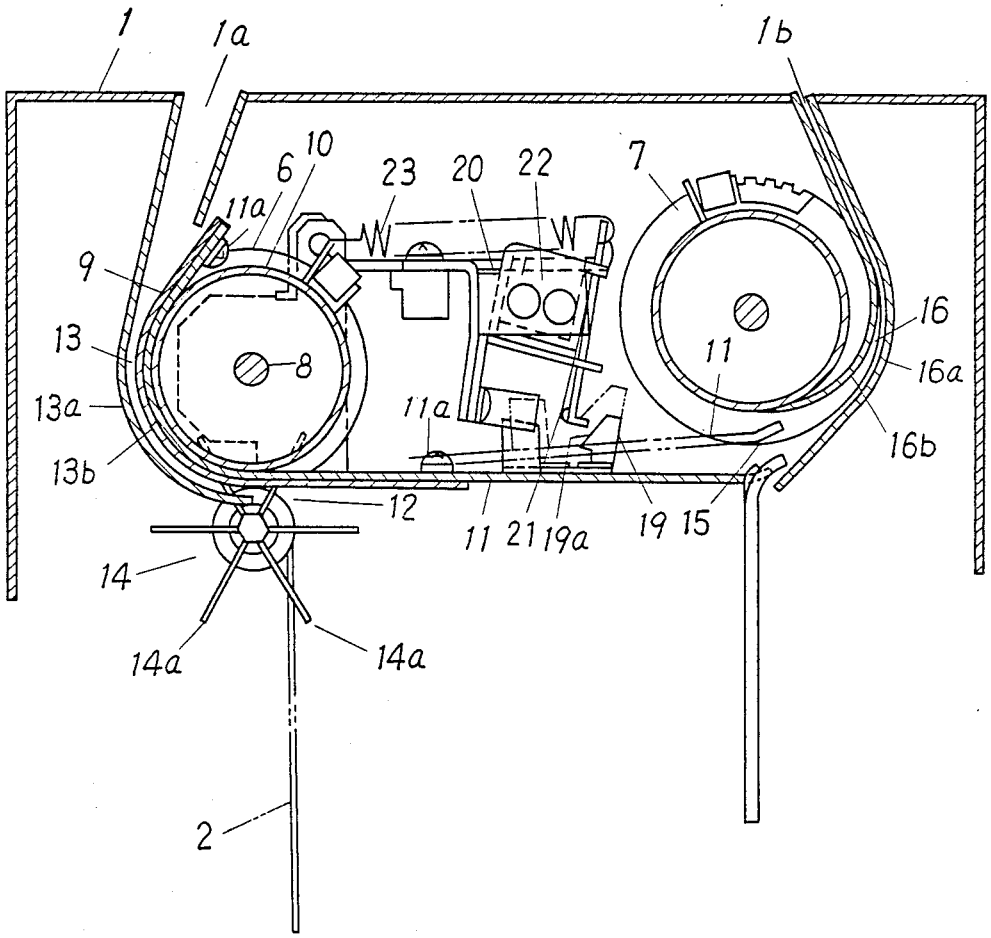
FIG. 2 is a cross-sectional view of the apparatus taken along a line different from that in FIG. 1.

A movable plate 9 and movable drum 10, formed as a single unit together therewith, as shown in FIG. 2, are rotatably mounted on the rotary shaft 8. One end of a gate lever 11 is fixed to the plate 9 with screws 11*a* and tightly disposed between the plate 9 and the drum 10, so that the gate lever 11 can extend almost horizontally. A note feeding opening 12 is formed between the one end of the gate lever 11 and the note storage means 2. Guide plates 13*a* and 13*b* form a note feeding path 13 in connection with the note feeding opening 12. A pair of wing wheels 14 are disposed at both ends of shaft 27, as shown in FIG. 3, so that the blades 14*a* of the wheels 14 can slightly tap downwardly the rear of the note A which is fed into the note storage compartment 2 through the note feeding opening 12. Near the delivery roller 7, the gate lever 11 and the note storage compartment 2 form a note delivery opening 15 therebetween. The opening 15 intercommunicates with a note delivery path 16 formed by guide plates 16*a* and 16*b*. The other end of the gate lever 11 is so associated with the rotation of the rotary shaft 8 that it can move downwardly to close the note delivery opening 15, or move upwardly to open the delivery opening 15. The note feeding opening 12 is provided at the fixed end of the gate lever 11. The upper end of an elastic stopping plate 17, which is adapted to be bent in an arc shape, is opposite to the lower part of the delivery roller 7, as shown in FIG. 1. There is provided a predetermined gap between the delivery roller 7 and the upper end of the elastic stopping plate 17, so that the note A can go through during a delivery operation. The lower end of the elastic stopping plate 17 is fixed to a frame 18 which is disposed on the note storage compartment 2. The tip of the note A fed into the note storage compartment 2 collides with the plate 17.

As shown in FIG. 2, there is disposed a hook member 19 on the gate lever 11. When the gate lever 11 moves upwardly (a note delivery operation), the hook member 19 comes into engagement with a locking plate 21 which is hung right above the hook member 19 from a fixed frame 20. The hook member 19 is disengaged from the locking plate 21 when the locking plate 21 is attracted by a solenoid 22. The hook member 19 has a cam-like portion 19*a*, so that the hook member 19 can easily engage the locking plate 21. A bias spring 23 is disposed between the fixed frame 20 and the rotatable drum 10 so that it rotates the rotatable drum 10 to move the other end of the gate lever 11 downwardly. A cantilever 24 is pivotally mounted on the rotary shaft 8, as shown in FIG. 1. One end of the cantilever 24 is, like the gate lever 11, held at its lower position by a bias spring 26 disposed between the other end of the cantilever 24 and the fixed frame 20. On the tip of the cantilever 24, there is mounted a second feeding roller 25 whose lower part protrudes slightly below the gate lever 11, so that the roller 25 feeds the note A to the delivery opening 15. The rotation power for rotating the roller 25 is imparted via a belt from a driver, not shown in the drawings.

FIG. 3 shows the arrangement of rollers including the rollers 5 and 6 to convey notes. There is provided a rotary shaft 27, under the rotary shaft 8, to which a roller 29 and a note pressing roller 28 in contact with the roller 6 are fixed.

Figure 4:
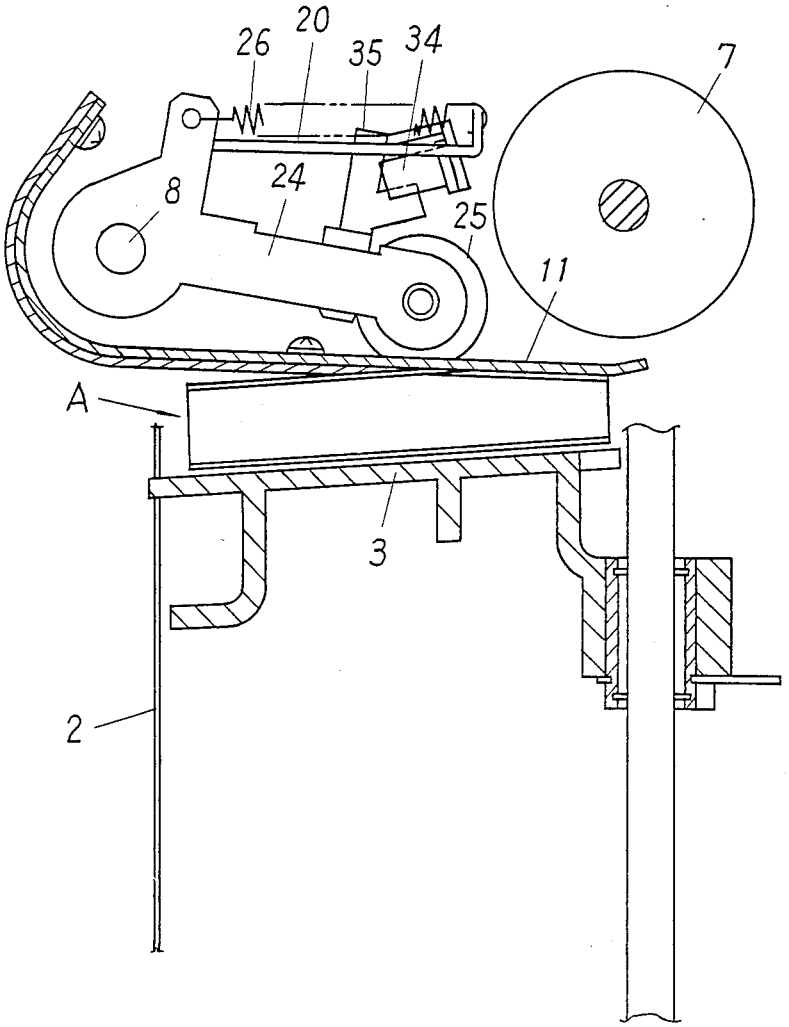
FIG. 4 is a partial sectional view for illustrating the operation for producing a space into which notes can fall.

FIG. 4 shows a sensor 34 mounted on the fixed frame 20 which detects that the roller 25 of the cantilever 24 has risen to a predetermined point. The sensor 34 is turned on (or off) by a protrusion 35 mounted on the cantilever 24 when the roller 25 has risen to the predetermined point.

Figure 5:
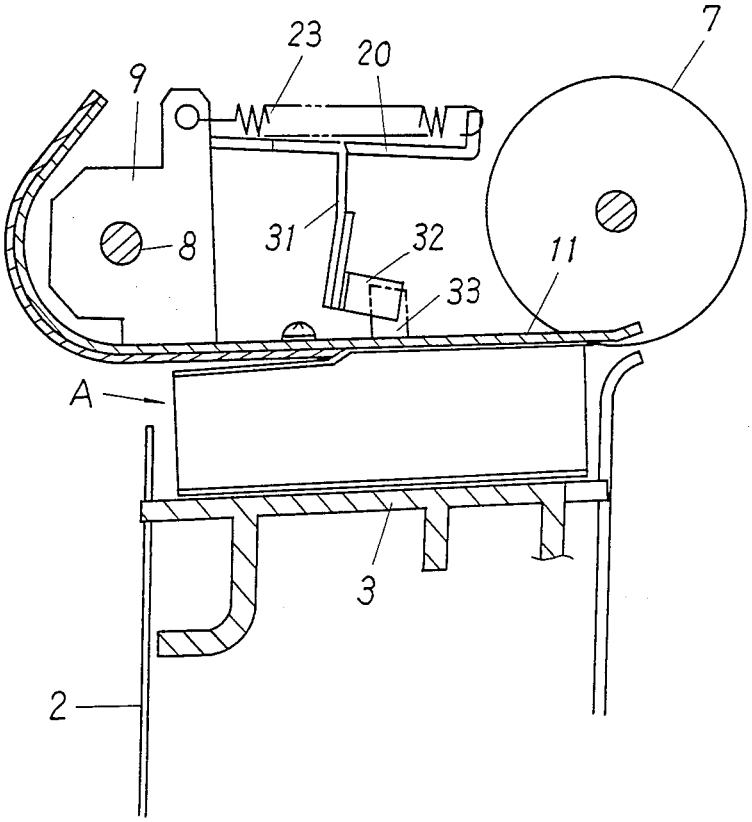
FIG. 5 is a partial sectional view for illustrating a note delivery operation.

In FIG. 5, there is mounted a sensor 32 on a bracket 31 hung from the fixed frame 20 which detects that the gate lever 11 has risen to a predetermined point. The sensor 32 is turned on (or off) by a protrusion 33 mounted on the gate lever 11.

The operation for the apparatus of FIG. 1 will be described hereinafter. Prior to storing the note A in the storage compartment 2, the pushing tray 3 is once moved upwardly to abut the roller 25 whose lower part protrudes slightly below the gate lever 11. The cantilever 24 is lifted by the pushing tray 3 to turn on sensor 34. Upon turning on the sensor 34, the pushing tray 3 stops. After the sensor 34 is turned on, the pushing tray 3 is moved downwardly for a predetermined time to form a certain volume of space thereon. Then, the note A is fed to the note feeding opening 12 with the aid of the rollers 5, 6 and 25. The note A is guided by the almost horizontal lower surface of the gate lever 11 and further fed into the space horizontally until the tip of the note A collides with the stopping plate 17 and stops. Then, the wheels 14 rotate to tap the rear end of the note A downwardly. Consequently, the note A falls spontaneously on the pushing tray 3. The note A falls with its rear end below as presented by note A′, to prevent succeeding notes from jamming. The operation mentioned above is repeated for all notes. A″ represents note A′ after it falls onto the pushing tray 3. The pushing tray 3 is moved downwardly in proportion to the total weight of the stored notes, maintaining the constant volume of the space and allowing notes to be stored smoothly.

The pushing tray 3 moves upwardly upon a withdrawal instruction so that the stored notes lift the cantilever 24 and further, the gate lever 11 to open the note delivery opening 15. When the gate lever 11 is lifted to the predetermined point, the sensor 32 is turned on to drive the roller 25 and the delivery rollers 7. The stored notes are discharged one after another into the note delivery path 26 through the note delivery opening 15. Because the pushing tray 3 moves upwardly during the delivery operation, the stored notes are compressed to a predetermined pressure, between the gate lever 11 and the pushing tray 3, even if they are loosely stacked up. This allows the stored notes, even crumpled, to be delivered smoothly one after another.

It should be understood that the above description is merely illustrative of this invention and that many changes and modifications may be made by those skilled in the art without departing from the scope of the invention which is defined by the appended claims.

What is claimed is:

1. A note storing apparatus comprising:

note storage means for storing notes;

pushing means disposed in said note storage means for receiving notes substantially horizontally thereon, said pushing means being upwardly movable for a note dispensing operation and downwardly movable to produce a space to receive notes for a note receiving operation;

first feeding roller means for feeding deposited notes into said space;

delivery roller means for delivering notes from said space to the outside of said note storage means;

gate lever means for compressing notes against said pushing means and for directing notes located on said pushing means to said delivery roller means when said pushing means is moved upwardly for a note dispensing operation, said gate lever means returning to a position allowing received notes to be guided into said space for a note receiving operation wherein said pushing means is downwardly displaced to produce said space.

2. A note storing apparatus according to claim 1, further comprising second feeding roller means disposed movably up and down between said first feeding roller means and said delivery roller means, said second feeding roller means being adapted to transfer notes located on said pushing means to said delivery roller means.

3. A note storing apparatus according to claim 2, further comprising rotary shaft means fixed to said first feeding roller means and cantilever means pivotally mounted on said rotary shaft means, said second feeding roller means being mounted on the tip of said cantilever means.

4. A note storing apparatus according to claim 1, further comprising sensor means disposed above said gate lever means for detecting the rise of said gate lever means to a predetermined point.

5. A note storing apparatus according to claim 2, further comprising sensor means disposed above said second feeding roller means for detecting the rise of said second feeding roller means to a predetermined point, said pushing means moving downwardly to a predetermined point in response to the output of said sensor means.

* * * * *